US008215028B2

(12) United States Patent
Eia

(10) Patent No.: US 8,215,028 B2
(45) **Date of Patent: *Jul. 10, 2012**

(54) SLURRIFICATION PROCESS

(75) Inventor: Jan Thore Eia, Kvernaland (NO)

(73) Assignee: M-I L.L.C., Houston, TX (US)

( * ) Notice: Subject to any disclaimer, the term of this patent is extended or adjusted under 35 U.S.C. 154(b) by 1091 days.

This patent is subject to a terminal disclaimer.

(21) Appl. No.: 12/121,550

(22) Filed: May 15, 2008

(65) Prior Publication Data

US 2008/0283295 A1 Nov. 20, 2008

Related U.S. Application Data

(60) Provisional application No. 60/938,231, filed on May 16, 2007.

(51) Int. Cl.
*F26B 11/00* (2006.01)

(52) U.S. Cl. ..... 34/60; 34/80; 34/90; 34/142; 34/218; 175/46; 175/66; 414/137.1; 414/137.9; 406/146; 406/197; 166/75.15; 166/335; 405/128; 210/87; 210/97

(58) Field of Classification Search ..... 34/60, 80, 34/90, 142, 210, 218, 105, 242; 175/46, 175/66; 414/137.1, 137.9; 406/146, 197; 166/75.15, 335; 405/128; 210/87, 97
See application file for complete search history.

(56) References Cited

U.S. PATENT DOCUMENTS 4,003,136 A * 1/1977 Vincent et al. ..... 34/385
4,126,519 A * 11/1978 Murray ..... 201/32
5,092,960 A * 3/1992 Brown ..... 159/48.1
5,129,469 A 7/1992 Jackson
5,303,786 A 4/1994 Prestridge et al.
5,964,304 A 10/1999 Morrison, Jr. et al.
6,585,115 B1 * 7/2003 Reddoch et al. ..... 209/3
6,640,912 B2 11/2003 Reddoch
6,709,216 B2 3/2004 Snowdon et al.
6,745,856 B2 6/2004 Simpson et al.

(Continued)

FOREIGN PATENT DOCUMENTS

CH 662748 A * 10/1987

(Continued)

OTHER PUBLICATIONS

Notification of Transmittal of the International Search Report and the Written Opinion of the International Searching Authority, or the Declaration for PCT Application No. PCT/US2008/063842, dated Oct. 29, 2008, (3 pages).

(Continued)

*Primary Examiner* — Stephen M. Gravini
(74) *Attorney, Agent, or Firm* — Osha • Liang LLP

(57) ABSTRACT

A system for slurrifying drill cuttings including a cuttings dryer, a pump, and a transfer line fluidly connecting the cuttings dryer and the pump, the transfer line having a fluid inlet for receiving a fluid. Furthermore, the system for slurrifying drill cuttings including a storage vessel fluidly connected to the pump for storing a slurry. Additionally, a method for slurrifying drill cuttings including drying drill cuttings in a cuttings drying to produce dry cuttings and combining a fluid with the dry cuttings to produce a slurry. Furthermore, the method includes mixing the slurry and the dry cuttings in a mixing pump and transferring the slurry to a storage vessel.

7 Claims, 9 Drawing Sheets

U.S. PATENT DOCUMENTS

| | | | | |
|---|---|---|---|---|
| 7,024,796 | B2 * | 4/2006 | Carin et al. | 34/363 |
| 7,024,800 | B2 * | 4/2006 | Carin et al. | 34/576 |
| 7,033,124 | B2 | 4/2006 | Snowdon et al. | |
| 7,487,601 | B2 * | 2/2009 | Carin et al. | 34/381 |
| 7,610,692 | B2 * | 11/2009 | Carin et al. | 34/388 |
| 7,617,617 | B2 * | 11/2009 | Gorbell et al. | 34/60 |
| 7,685,737 | B2 * | 3/2010 | Gorbell et al. | 34/86 |
| 7,866,060 | B2 * | 1/2011 | Carin et al. | 34/487 |
| 7,882,646 | B2 * | 2/2011 | Gorbell et al. | 34/514 |
| 7,966,741 | B2 * | 6/2011 | Gorbell et al. | 34/60 |
| 7,975,398 | B2 * | 7/2011 | Carin et al. | 34/60 |
| 2002/0033278 | A1 | 3/2002 | Reddoch | |
| 2004/0139866 | A1 * | 7/2004 | Lopez | 100/7 |
| 2006/0010712 | A1 * | 1/2006 | Carin et al. | 34/443 |
| 2006/0010714 | A1 * | 1/2006 | Carin et al. | 34/514 |
| 2006/0101665 | A1 * | 5/2006 | Carin et al. | 34/513 |
| 2006/0101881 | A1 * | 5/2006 | Carin et al. | 71/21 |
| 2006/0201024 | A1 * | 9/2006 | Carin et al. | 34/576 |
| 2006/0254079 | A1 * | 11/2006 | Gorbell et al. | 34/363 |
| 2006/0254080 | A1 * | 11/2006 | Carin et al. | 34/363 |
| 2006/0254081 | A1 * | 11/2006 | Carin et al. | 34/576 |
| 2007/0163142 | A1 * | 7/2007 | Carin et al. | 34/282 |
| 2008/0104858 | A1 * | 5/2008 | Carin et al. | 34/282 |
| 2008/0105019 | A1 * | 5/2008 | Carin et al. | 71/15 |
| 2008/0110043 | A1 * | 5/2008 | Carin et al. | 34/487 |
| 2008/0172899 | A1 * | 7/2008 | Carin et al. | 34/90 |
| 2008/0189979 | A1 * | 8/2008 | Carin et al. | 34/576 |
| 2008/0283295 | A1 * | 11/2008 | Eia | 175/46 |
| 2009/0183424 | A1 * | 7/2009 | Gorbell et al. | 44/505 |
| 2009/0188127 | A1 * | 7/2009 | Gorbell et al. | 34/388 |
| 2009/0255144 | A1 * | 10/2009 | Gorbell et al. | 34/385 |
| 2010/0139116 | A1 * | 6/2010 | Carin et al. | 34/516 |
| 2011/0172382 | A1 * | 7/2011 | Yeh et al. | 526/282 |

FOREIGN PATENT DOCUMENTS

| | | | |
|---|---|---|---|
| CH | 662748 | A5 * | 10/1987 |
| EP | 934998 | A2 * | 8/1999 |
| GB | 2464004 | A * | 4/2010 |
| JP | 57081025 | A * | 5/1982 |
| JP | 58127707 | A * | 7/1983 |
| WO | 9904134 | | 1/1999 |

OTHER PUBLICATIONS

Written Opinion of the International Searching Authority for PCT Application No. PCT/US2008/063842, dated Oct. 29, 2008, (5 pages).

International Search Report for PCT Application No. PCT/US2008/063842, dated Oct. 29, 2008, (3 pages).

Examination Report issued in corresponding British Patent Application No. GB0921837.1; Dated Jun. 1, 2011 (3 pages).

* cited by examiner

SLURRIFICATION PROCESS

CROSS REFERENCE TO RELATED APPLICATIONS

This Application claims the benefit of the following application under 35 U.S.C. 119(e); U.S. Provisional Application Ser. No. 60/938,231 filed on May 16, 2007, incorporated by reference in its entirety herein.

BACKGROUND

1. Field of the Disclosure

Embodiments disclosed herein relate generally to systems and methods for producing slurries for re-injection at a work site. More specifically, embodiments disclosed herein relate to systems and methods for slurrifying drill cuttings for re-injection at a work site.

2. Background

In the drilling of wells, a drill bit is used to dig many thousands of feet into the earth's crust. Oil rigs typically employ a derrick that extends above the well drilling platform. The derrick supports joint after joint of drill pipe connected end-to-end during the drilling operation. As the drill bit is pushed further into the earth, additional pipe joints are added to the ever lengthening "string" or "drill string". Therefore, the drill string includes a plurality of joints of pipe.

Fluid "drilling mud" is pumped from the well drilling platform, through the drill string, and to a drill bit supported at the lower or distal end of the drill string. The drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the platform, it is contaminated with small pieces of shale and rock that are known in the industry as well cuttings or drill cuttings. Once the drill cuttings, drilling mud, and other waste reach the platform, a "shale shaker" is typically used to remove the drilling mud from the drill cuttings so that the drilling mud may be reused. The remaining drill cuttings, waste, and residual drilling mud are then transferred to a holding trough for disposal. In some situations, for example with specific types of drilling mud, the drilling mud may not be reused and it must be disposed. Typically, the non-recycled drilling mud is disposed of separate from the drill cuttings and other waste by transporting the drilling mud via a vessel to a disposal site.

The disposal of the drill cuttings and drilling mud is a complex environmental problem. Drill cuttings contain not only the residual drilling mud product that would contaminate the surrounding environment, but may also contain oil and other waste that is particularly hazardous to the environment, especially when drilling in a marine environment.

In the Gulf of Mexico, for example, there are hundreds of drilling platforms that drill for oil and gas by drilling into the subsea floor. These drilling platforms may be used in places where the depth of the water is many hundreds of feet. In such a marine environment, the water is typically filled with marine life that cannot tolerate the disposal of drill cuttings waste. Therefore, there is a need for a simple, yet workable solution to the problem of disposing of well cuttings, drilling mud, and/or other waste in marine and other fragile environments.

Traditional methods of disposal include dumping, bucket transport, cumbersome conveyor belts, screw conveyors, and washing techniques that require large amounts of water. Adding water creates additional problems of added volume and bulk, pollution, and transport problems. Installing conveyors requires major modification to the rig area and involves extensive installation hours and expense.

Another method of disposal includes returning the drill cuttings, drilling mud, and/or other waste via injection under high pressure into an earth formation. Generally, the injection process involves the preparation of a slurry within surface-based equipment and pumping the slurry into a well that extends relatively deep underground into a receiving stratum or adequate formation. The basic steps in the process include the identification of an appropriate stratum or formation for the injection; preparing an appropriate injection well; formulation of the slurry, which includes considering such factors as weight, solids content, pH, gels, etc.; performing the injection operations, which includes determining and monitoring pump rates such as volume per unit time and pressure; and capping the well.

In some instances, the cuttings, which are still contaminated with some oil, are transported from a drilling rig to an offshore rig or ashore in the form of a thick heavy paste or slurry for injection into an earth formation. Typically the material is put into special skips of about 10 ton capacity that are loaded by crane from the rig onto supply boats. This is a difficult and dangerous operation that may be laborious and expensive.

U.S. Pat. No. 6,709,216 and related patent family members disclose that cuttings may also be conveyed to and stored in an enclosed, transportable vessel, where the vessel may then be transported to a destination, and the drill cuttings may be withdrawn. The transportable storage vessel has a lower conical section structured to achieve mass flow of the mixture in the vessel, and withdrawal of the cuttings includes applying a compressed gas to the cuttings in the vessel. The transportable vessels are designed to fit within a 20 foot ISO container frame. These conical vessels will be referred to herein as ISO vessels.

As described in U.S. Pat. No. 6,709,216 and family, the ISO vessels may be lifted onto a drilling rig by a rig crane and used to store cuttings. The vessels may then be used to transfer the cuttings onto a supply boat, and may also serve as buffer storage while a supply boat is not present. Alternatively, the storage vessels may be lifted off the rig by cranes and transported by a supply boat.

Space on offshore platforms is limited. In addition to the storage and transfer of cuttings, many additional operations take place on a drilling rig, including tank cleaning, slurrification operations, drilling, chemical treatment operations, raw material storage, mud preparation, mud recycle, mud separations, and others.

Due to the limited space, these operations may be modularized, in which modules are swapped out when not needed or when space is needed for the equipment. For example, cuttings containers may be offloaded from the rig to make room for modularized equipment used for slurrification. These lifting operations, as mentioned above, are difficult, dangerous, and expensive. Additionally, many of these modularized operations include redundant equipment, such as pumps, valves, and tanks or storage vessels.

Slurrifications systems that may be moved onto a rig are typically large modules that are fully self-contained, receiving cuttings from a drilling rig's fluid mud recovery system. For example, PCT Publication No. WO 99/04134 discloses a process module containing a first slurry tank, grinding pumps, a system shale shaker, a second slurry tank, and optionally a holding tank. The module may be lifted by a crane on to an offshore drilling platform.

Slurrification systems may also be disposed in portable units that may be transported from one work site to another. As disclosed in U.S. Pat. No. 5,303,786, a slurrification system may be mounted on a semi-trailer that may be towed between work sites. The system includes, inter alia, multiple tanks, pumps, mills, grinders, agitators, hoppers, and conveyors. As discussed in U.S. Pat. No. 5,303,786, the slurrification system may be moved to a site where a large quantity of material to be treated is available, such as existing or abandoned reserve pits that hold large quantities of cuttings.

U.S. Pat. No. 6,745,856 discloses another transportable slurrification system that is disposed on a transport vehicle. The transport vehicle (i.e., a vessel or boat) is stationed proximate the work site (i.e., offshore platform) and connected to equipment located at the work site while in operation. Deleterious material is transferred from the work site to the transport vehicle, wherein the deleterious material is slurrified. The slurry may be transferred back to the work site for, in one example, re-injection into the formation. Alternatively, the slurry may be transported via the transport vehicle to a disposal site. As disclosed in U.S. Pat. No. 6,745,856, storage vessels are disposed on the transport vehicle for containing the slurry during transportation. While in-transit to the disposal site, agitators disposed in the storage vessels may agitate the slurry to keep the solids suspended in the fluid.

While these systems and methods provide improved processes in slurrification and re-injection systems, they require difficult, dangerous, and expensive lifting and installation operations, as described above. Additionally, these processes may require lengthy installation and processing times that may reduce the overall efficiency of the work site.

A slurrification system is used to create a slurry for a cuttings re-injection system. Typically, slurrification systems receive cuttings and convert them into a pumpable slurry. Elements of a slurrification system generally include a fine-solids ("fines") tank, a coarse-solids ("coarse") tank, a classification system, and a storage vessel, wherein drill cuttings are dried, separated, and transferred to a cuttings re-injection system or stored for further processing. After preparation of the slurry, the slurry is pumped to a storage vessel, until an injection pump is used to pump the slurry down a wellbore.

In operation, attempts to produce a slurry that meet local environmental regulations and operational regulations has proven problematic. Current slurrification systems are operationally inefficient. For example, adjustments to the drilling operation including adjustments to cuttings volume production and rate of penetration of the wellbore may cause slurrification process and cuttings re-injection inefficiencies. Moreover, increasingly stringent cuttings-discharge regulations have pressured operators and drilling contractors to reduce drilling waste volumes and recover products for re-use. Thus, there exists a continuing need for more efficient slurrification methods and systems, specifically, for slurrification systems for use in preparing slurries for re-injecting cuttings into a wellbore.

SUMMARY OF DISCLOSURE

In one aspect, embodiments disclosed herein relate to a system for slurrifying drill cuttings including a cuttings dryer, a pump, and a transfer line fluidly connecting the cuttings dryer and the pump, the transfer line having a fluid inlet for receiving a fluid. Furthermore, the system for slurrifying drill cuttings including a storage vessel fluidly connected to the pump for storing a slurry.

In another aspect, embodiments disclosed herein relate to a method for slurrifying drill cuttings including drying drill cuttings in a cuttings drying to produce dry cuttings and combining a fluid with the dry cuttings to produce a slurry. Furthermore, the method includes mixing the slurry and the dry cuttings in a mixing pump and transferring the slurry to a storage vessel.

Other aspects and advantages of the invention will be apparent from the following description and the appended claims.

DETAILED DESCRIPTION

In one aspect, embodiments disclosed herein relate generally to systems and methods for producing slurries for re-injection at a work site. More specifically, embodiments disclosed herein relate to systems and methods for slurrifying drill cuttings for re-injection at a work site.

Figure 1:
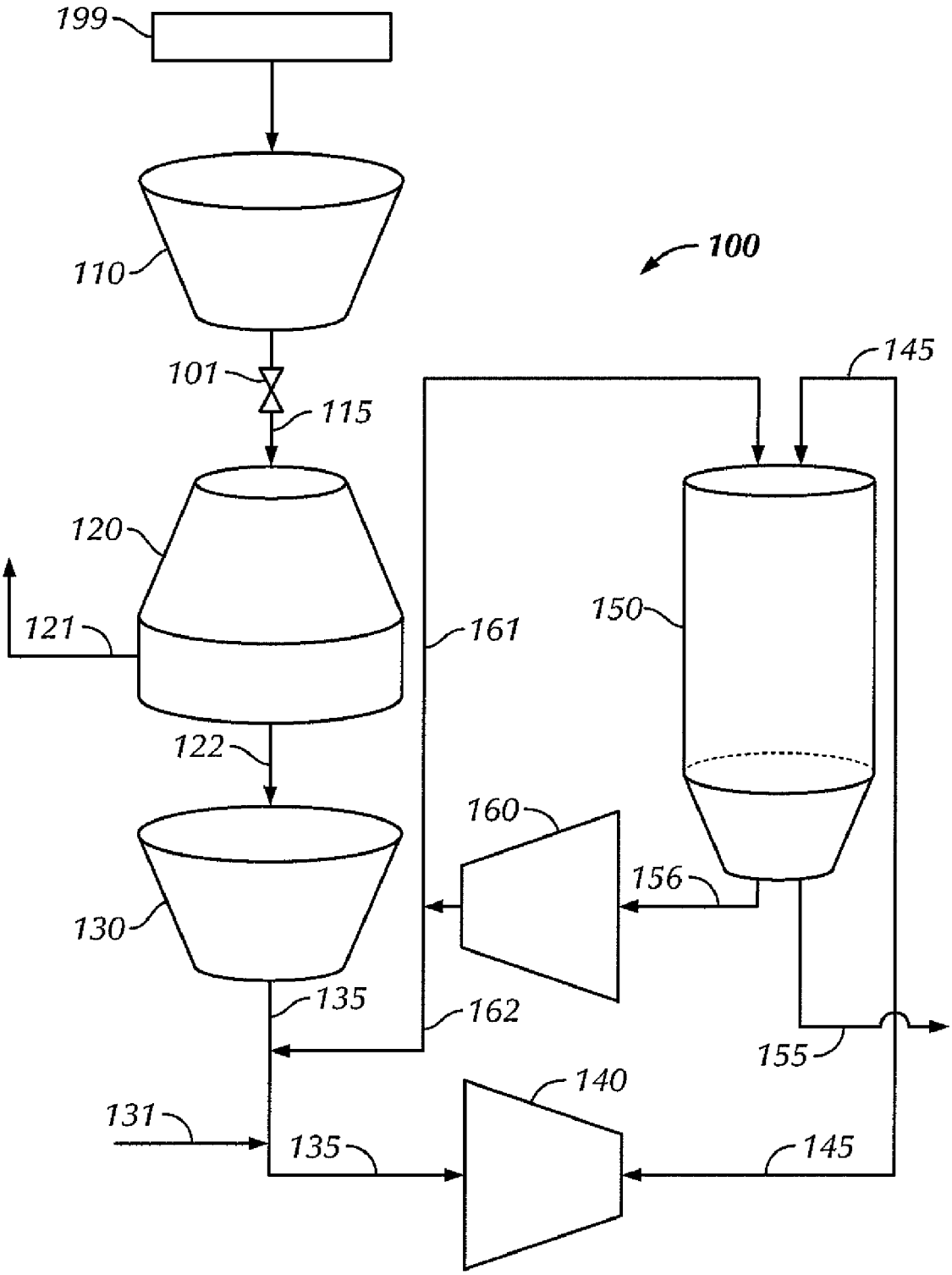
FIG. 1 shows a system for the slurrification of drill cuttings according to one embodiment of the present disclosure.

Referring initially to FIG. 1, a slurrification system 100 for slurrifying drill cuttings in accordance with one embodiment of the present disclosure is shown. In this embodiment, drill cuttings ("cuttings"), generated during the drilling process pass through a primary cleaning operation 199 into a buffer tank 110. Buffer tank 110 may include any vessel known in the art that has an inlet (not independently shown) to receive cuttings and an outlet (not independently illustrated) to expel the cuttings. Buffer tank 110 may be used to compensate for fluxuations in the cuttings flow rate when transferring the cuttings from one piece of equipment, such as from a primary cleaning operation 199, to slurrification system 100. For example, in an embodiment that deposits the cuttings from primary cleaning operation 199 to slurrification system 100 in batches, buffer tank 110 converts the batch flow rate to a relatively consistent flow rate at buffer tank 110 outlet. To control the flow of cuttings through slurrification system 100, a valve 101 may be added in-line to the buffer tank to control the speed of the slurrification process 100. Those of ordinary skill in the art will appreciate that valve 101 may include airtight rotational valves, three-way valves, or other valves capable of controlling a flow of cuttings and/or slurry. In some embodiments, valve 101 may be added to the outlet of buffer tank 110. Thus, the flow of cuttings in slurrification system 100 may be controlled at buffer tank 110 by adjusting valve 101 settings.

In FIG. 1, buffer storage tank 110 may transfer the cuttings into a cuttings dryer 120 through a variety of conveyance systems known in the art. Examples of conveyance systems may include gravity feeds, pneumatic transfer, vacuum transfer, fluid connections, and mechanical conveyers. In FIG. 1, cuttings are transferred from buffer tank 110 to cuttings dryer 120 through a transfer line 115.

Figure 2:
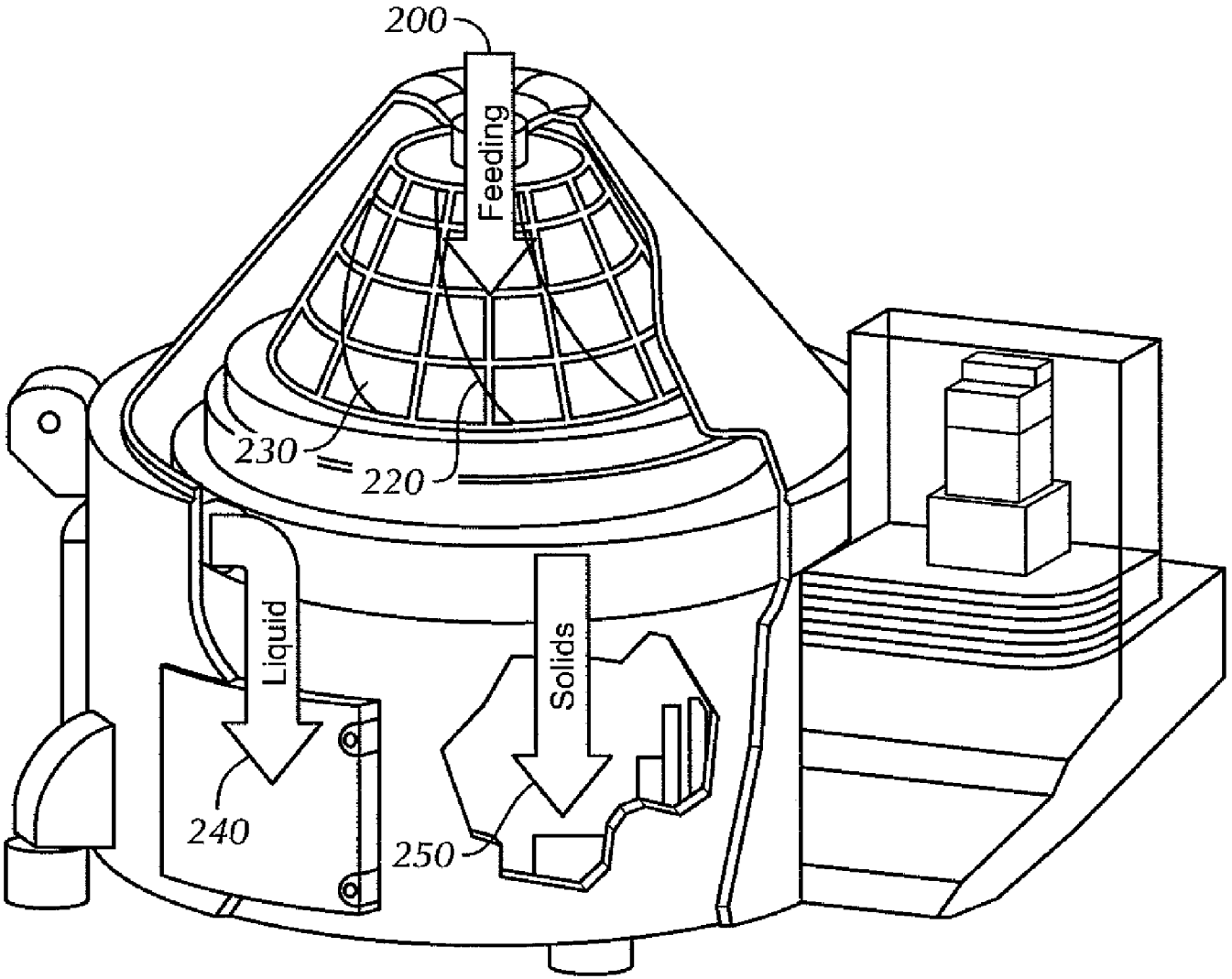
FIG. 2 shows a schematic view for the cuttings dryer according to one embodiment of the present disclosure.

In this embodiment, the cuttings are introduced into cuttings dryer 120, wherein high G-forces separate the liquids and solids. An example of a cuttings dryer 120 that may be used in embodiments disclosed herein is the VERTI-G™ CUTTINGS DRYER, commercially available from M-I LLC, in Houston, Tex., Referring briefly to FIG. 2, a cuttings dryer 200 in accordance with one embodiment of the present disclosure is shown. The flow of cuttings into cuttings dryer 200 may be controlled by a programmable logic controller ("PLC"), which will be discussed below. The flow of cuttings therethrough may be at a constant rate or a batch-flow rate, depending on the requirements of a given operation. Cuttings dryer 200 may include a charge hopper (not independently shown), wherein widely spaced, independently adjustable flights 220 continuously direct cuttings to a screen surface 230. Flights 220 within cuttings dryer 200 impart a rolling action to the cuttings that promotes further separation and prevents screen plugging. The cuttings may be held in cuttings dryer 200 by G-forces created by spinning the cone diameter of cuttings dryer 200. As the cuttings remain in cuttings dryer 200, fluid waste product separates out from the cuttings and flows through an outlet 240.

The fluid waste may include chemical additives, weighting agents, and/or other agents added during a drilling operation. Separation may occur as cuttings make contact with the fine-mesh, high-capacity centrifuge screen surface 230. As the cuttings move through the cuttings dryer, the cuttings become dryer and the waste fluid becomes cleaner due to the increasingly finer screen surface 230. The dry cuttings may be discharged at a screen bottom 250. In one embodiment, the cuttings may be transferred to a hopper 130 through a solids outlet 122, as shown in FIG. 1. In another embodiment, the cuttings may fall by gravity into a water-flushed cuttings trough and shunted from cuttings dryer 200. In still another embodiment, the waste product may be collected for disposal. The fluid waste may pass through outlet 240. The fluid waste may then be collected for disposal to be processed for further use in the drilling operation.

Referring back to FIG. 1, cuttings dryer 120 may provide a method for further reducing the size of the cuttings. The stress created by cuttings dryer 120 is exerted on the cuttings, thus further breaking down the particle size of the cuttings transferred therethrough. This aspect of the cuttings dryer may be comparable to a grinder, such that large cuttings may enter cuttings dryer 120, and exit cuttings dryer 120 with a reduced particle size.

Cuttings dryer 120 may transfer waste fluid through a waste fluid line 121 and dry cuttings through a solids outlet 122. The dry cuttings then pass into a hopper 130, such as, for example, a venturi hopper. Hopper 130 provides for the continuous collection and discharge of contents, including cuttings and fluid, in slurrification system 100. Those of ordinary skill in the art will appreciate that other hoppers 130, operable as described above, may also be used with embodiments of the present disclosure.

In one embodiment, a fluid may be introduced into slurrification system 100 after the cuttings pass through cuttings dryer 120. In FIG. 1, a fluid inlet 131 may provide for the injection of a fluid into a transfer line 135, fluidly connecting a hopper 130 and a pump 140. In such an embodiment, the fluid injected from fluid inlet 131 into transfer line 135 may include, for example, water, sea water, brine solution, or liquid polymers, as would typically be used in preparation of a slurry for re-injection. The water and additives may come from storage tanks, fluid lines, and other available sources of water and additives known to those of ordinary skill in the art.

Transfer line 135 is fluidly connected to pump 140, wherein the fluid and cuttings from slurrification system 100 enter pump 140. In one embodiment, unmixed cuttings and fluid may be transferred to pump 140 wherein the fluid combines with the cuttings in pump 140. More specifically, in such an embodiment, pump 140 facilitates the mixing of the fluid with the cuttings, thereby creating a fluid-solid mixture. In one aspect, pump 140 may create a vacuum which draws the fluid and cuttings into pump 140. The fluid-solid mixture may be subjected to mechanical and hydraulic shear to create a slurry. One example of a pump that may be used with embodiments disclosed herein is the FLASHBLEND™ HIGH SHEAR POWDER/LIQUID MIXER, commercially available from Silverson Machines, Inc. However, other mixing and pumping devices, operable as disclosed above, may alternatively be used with embodiments of the present methods and systems. Those of ordinary skill in the art will appreciate that examples of other pumps that may be used to facilitate the mixing of a solid and fluid include centrifugal pumps. Pump 140 may also include design features such as hardfacing over rotors or stators, as well as other features known to those of skill in the art to further extend the life and/or effectiveness of the components.

In FIG. 1, the cuttings and fluid are mixed in pump 140 to create a slurry. The slurry is then transferred through a slurry transfer line 145, fluidly connecting pump 140 and a storage vessel 150. Those of ordinary skill in the art will appreciate that storage vessel 150 may include any type of storage vessel known in the art, such as, for example, vacuum systems and ISO-vessels. One type of ISO-vessel that may be used in embodiments disclosed herein includes an ISO-PUMP™, commercially available from M-I LLC, Houston, Tex. In such an embodiment, storage vessel 150 may be enclosed within a support structure. The support structure may protect and/or allow the transfer of storage vessel 150 from, for example, a supply boat to an offshore rig. Generally, a pneumatic transfer device includes a pressure vessel having a lower angled section to facilitate the flow of cuttings between the pneumatic transfer device and other processing and/or transfer equipment. A further description of pneumatic transfer devices that may be used with embodiments of the present disclosure are discussed in U.S. Pat. No. 7,033,124, incorporated by reference herein. Those of ordinary skill in the art will appreciate that alternate geometries of pneumatic transfer devices, also including those with lower sections that are not conical, may be used in certain embodiments of the present disclosure.

Once the slurry is discharged from storage vessel 150, the slurry may enter cuttings re-injection ("CRI") transfer line 155, wherein the slurry may be transferred to a cuttings re-injection system for further processing, discussed in detail below. In another embodiment, storage vessel 150 may store a slurry for future use. Such an embodiment may provide a buffer against periodic high rates of penetration and slurry production. An aspect of the embodiments discussed above may also include suspending conveyance of the slurry during discharge from storage vessel 150 to a cuttings re-injection system.

Still referring to FIG. 1, storage vessel 150 may also be in fluid communication with a second pump 160. Second pump 160 may be used to circulate the slurry to transfer line 135 or back to storage vessel 150 for her processing. The slurry enters second pump 160 from a transfer line 156, wherein pump 160 circulates the slurry to transfer line 162 or to transfer line 161, depending on operating conditions.

In another embodiment, second pump 160 may be configured to grind or further reduce the particle size of the cuttings suspended in the slurry. For example, second pump 160 may be a centrifugal pump, as disclosed in U.S. Pat. No. 5,129,469, incorporated by reference herein. In this embodiment, second pump 160 may have a cylindrical casing with an interior impeller space formed therein. Additionally, second pump 160 may include an impeller with backward swept blades with an open face on both sides, that is, the blades or vanes are swept backward with respect to a direction of rotation of the impeller and are not provided with opposed side plates forming a closed channel between the impeller fluid inlet area and the blade tips. The casing may have a tangential discharge passage formed by a casing portion. The concentric casing of second pump 160 and the configuration of the impeller blades provide a shearing action that reduces the particle size of drill cuttings. The blades of the impeller may be coated with a material, for example, tungsten carbide, to reduce wear of the blades. Those of ordinary skill in the art will appreciate that any pump known in the art for reducing the size of solids in a slurry may be used without departing from the scope of embodiments disclosed herein.

In operation, cuttings from a primary cleaning system may be transferred to a buffer tank. A buffer tank may transfer the cuttings into a cuttings dryer to produce dry cuttings. Dry cuttings may be combined with a fluid to produce a slurry with entrained cuttings. The slurry may be mixed in a mixing pump and transferred to a storage vessel for further processing, such as, for example, in a cuttings re-injection system.

Figure 3:
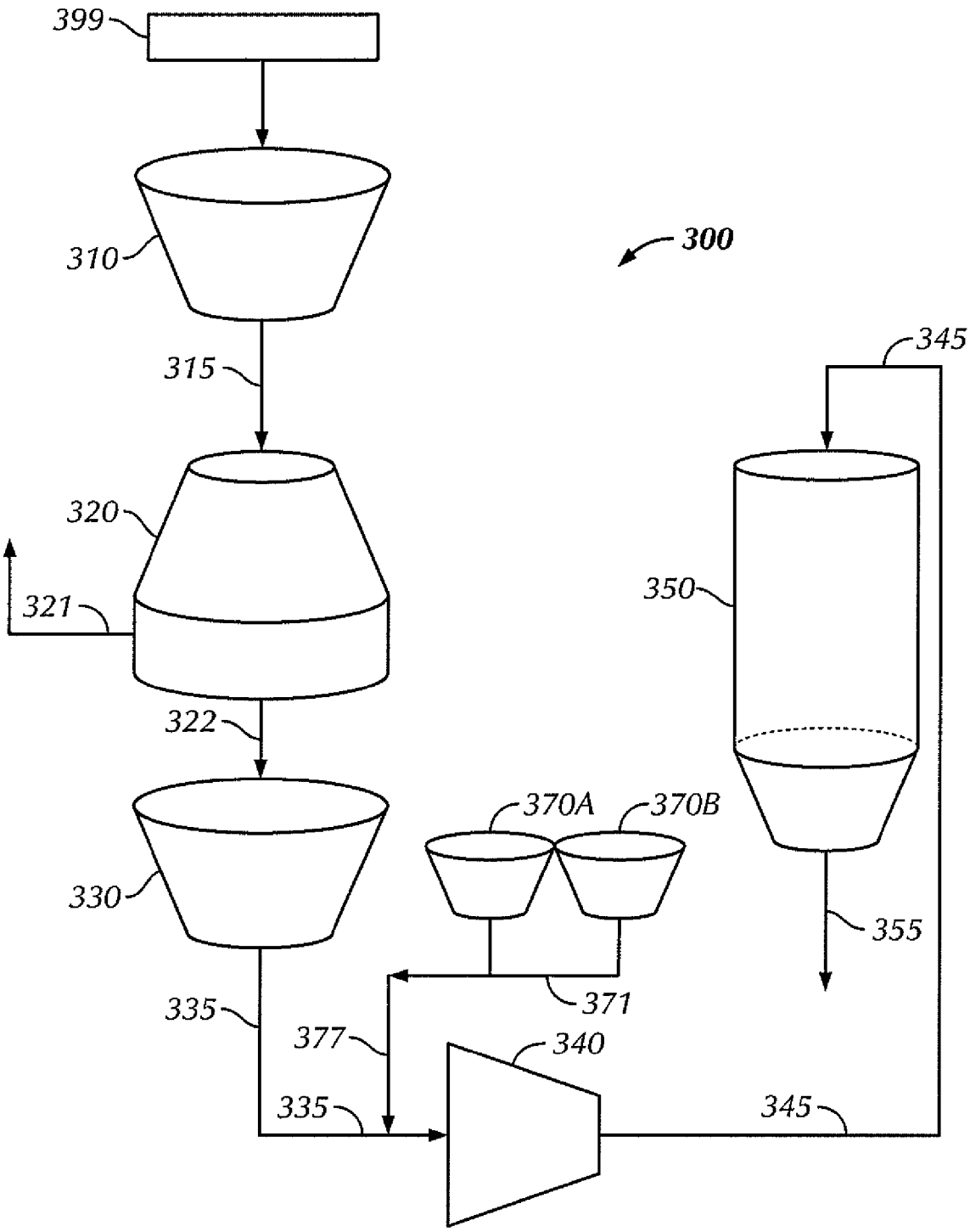
FIG. 3 shows a system for the slurrification of drill cuttings according to one embodiment of the present disclosure.

Referring to FIG. 3, a system 300 for slurrifying drill cuttings in accordance with one embodiment of the present disclosure is shown. In this embodiment, cuttings from a primary cleaning operation 399 enter slurrification system 300. In slurrification system 300, a buffer tank 310, a transfer line 315, a cuttings dryer 320, a waste fluid line 321, a solids outlet 322, a hopper 330, and a transfer line 335 operate as described above with respect to slurrification system 100 at FIG. 1. In the embodiment as shown in FIG. 3, a mixture of water and additives may be introduced into transfer line 335 via a fluid transfer line 377. According to this embodiment, water from a tank 370A and additives from tank 370B mix at connection point 371 prior to entering transfer line 335. Those of ordinary skill in the art will appreciate that the additives may include weighting agents and/or chemical additives added for the benefit of the slurry, and may be added from storage tanks, fluid lines, and other available sources of water and additives.

In FIG. 3, the cuttings and fluid pass through transfer line 335 to a pump 340 as described above. The cuttings and fluid mix in pump 340, to create a slurry. The slurry may be transferred to a storage vessel 350 via a slurry transfer line 345, wherein the slurry may be held for a period of time or transferred to a cuttings re-injection system via a CRI transfer line 355, depending on operational considerations. The operation of storage vessel 350 is similar to the operation discussed above with respect to storage vessel 150 in FIG. 1.

Figure 4:
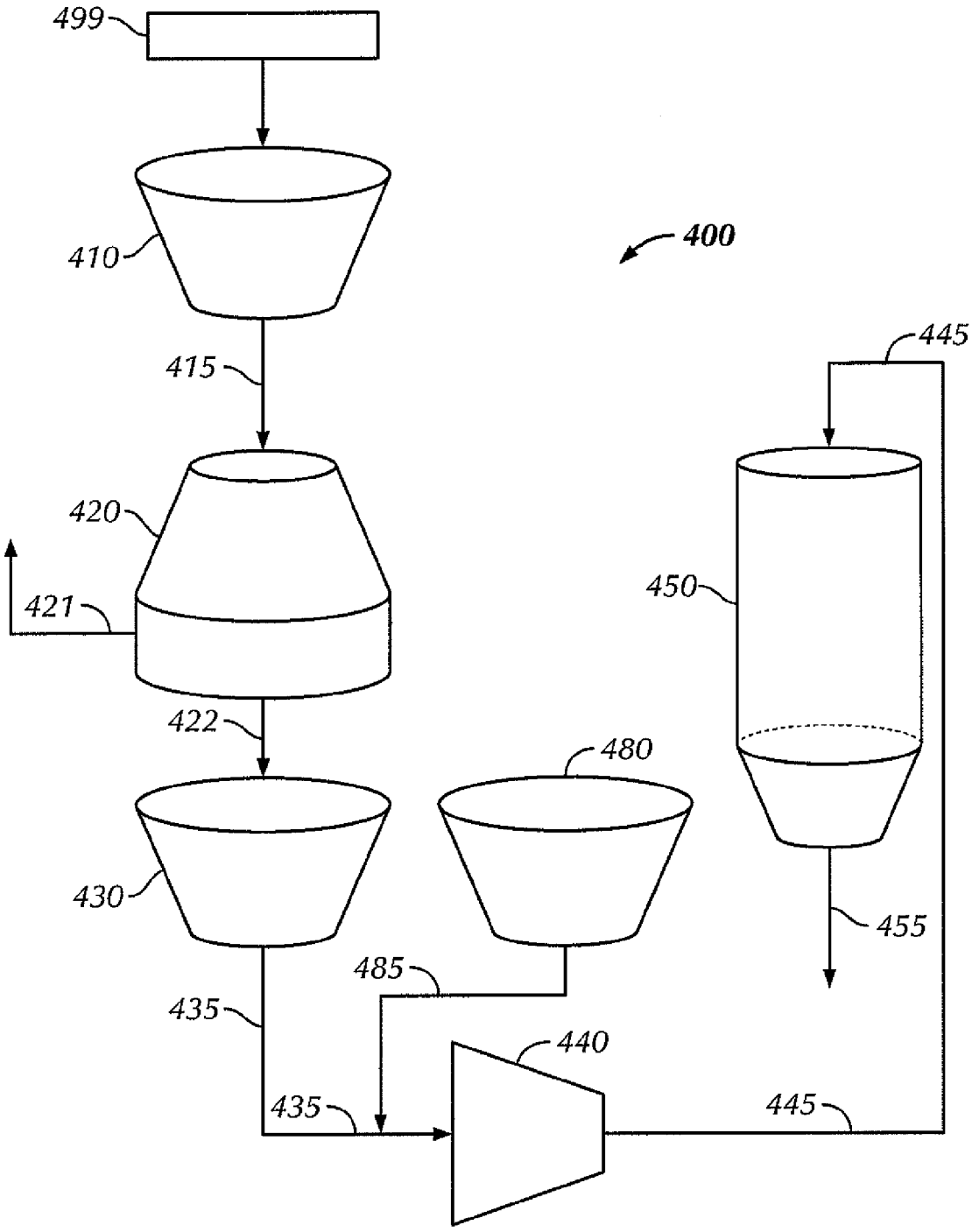
FIG. 4 shows a system for the slurrification of drill cuttings according to one embodiment of the present disclosure.

Referring to FIG. 4, a system 400 for slurrifying drill cuttings in accordance with one embodiment of the present disclosure is shown. In this embodiment, cuttings from a primary cleaning operation 499 enter slurrification system 400. In slurrification system 400, a buffer tank 410, a transfer line 415, a cuttings dryer 420, a waste fluid line 421, a solids outlet 422, a hopper 430, and a transfer line 435 operate as described above with respect to slurrification system 100 at FIG. 1. In this embodiment, fluid from a fluid reservoir 480 is transferred into transfer line 435 via fluid transfer line 485.

Examples of reservoirs may include storage tanks, pits, collection vats, waste vessels, and those of ordinary skill in the art will appreciate that such reservoirs may already exist as part of existing rig infrastructure. Those of ordinary skill in the art will also appreciate that the water, additives, and fluid may enter the system through various fluid transfer methods, as discussed above.

In FIG. 4, the cuttings and fluid pass from transfer line 435 to a pump 440 as described above. The cuttings and fluid mix in pump 440 to create a slurry. The slurry may be transferred to a storage vessel 450 via a slurry transfer line 445, wherein the slurry may be held for a period of time or transferred to a cuttings re-injection system (not independently shown) via a CRI transfer line 455, depending on operational considerations.

While FIG. 1, FIG. 3, and FIG. 4 show embodiments in accordance with the present disclosure, those of ordinary skill in the art will appreciate that fluid may be introduced at any time after a cuttings dryer and prior to storage or re-injection in a slurrification system. For example, fluid may be transferred into a slurrification system using a hopper, a fluid transfer line, and/or a pump.

Figure 5:
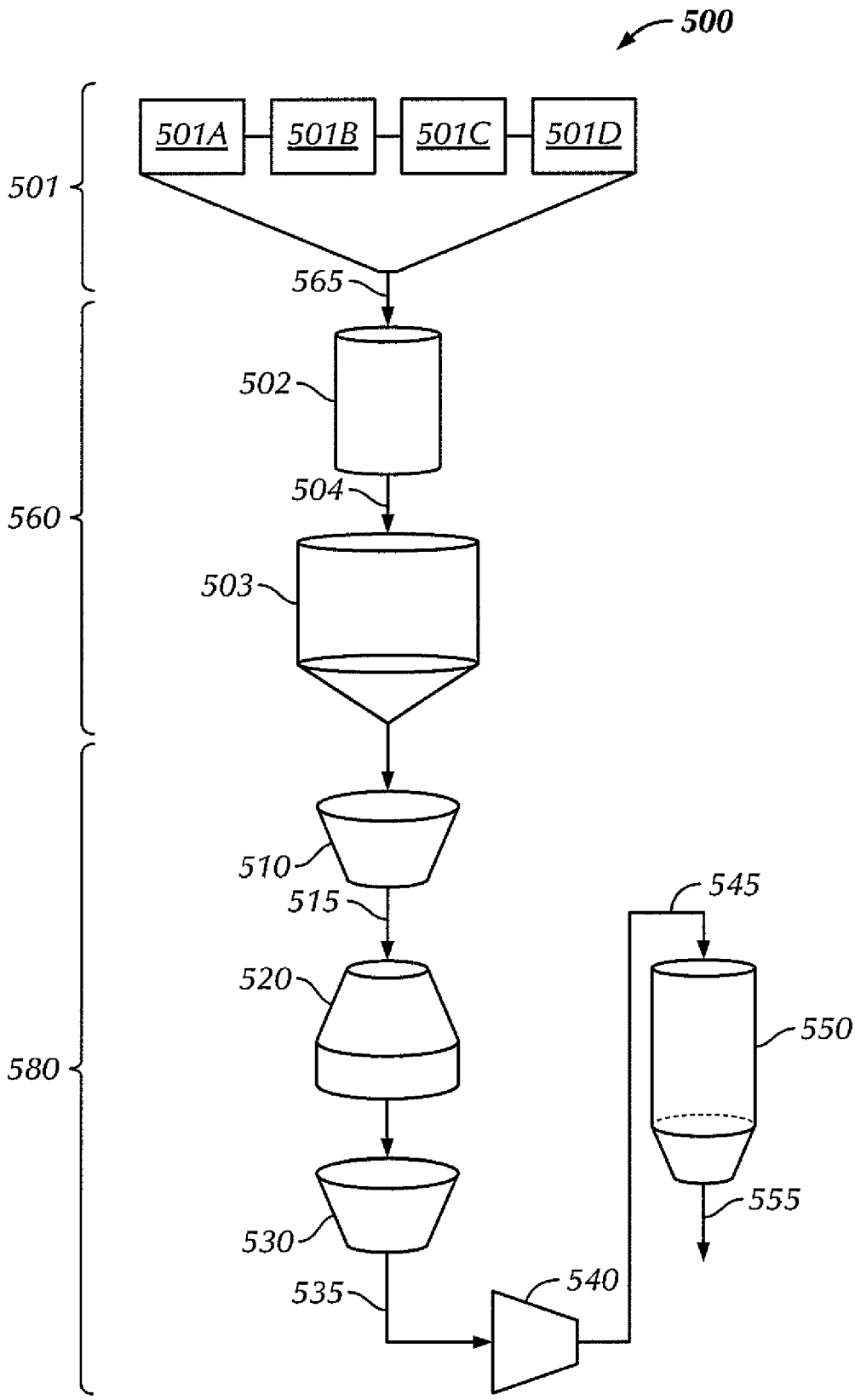
FIG. 5 shows a system for the slurrification of drill cuttings according to one embodiment of the present disclosure.

Referring to FIG. 5, a cuttings processing system 500 in accordance with one embodiment of the present disclosure is shown. In this embodiment, a slurrification system 580, as described in FIG. 1, FIG. 3, and FIG. 4, may be in fluid communication with a primary cleaning operation 501. A drill solids conveyor (not independently shown) may be connected to shakers 501A, 501B, 501C, 501D, or other upstream cleaning equipment used to separate well fluids from solids. A drill solids conveyor may include piping, troughs, or conveyor belt systems, as well as valves and actuation members to control the flow of solids through cuttings processing system 500. Examples of primary cleaning operations 501 may include screen separators, hydrocyclones, dryers, shakers, centrifuges, thermal desorption systems, and other equipment known to those of ordinary skill in the art for drying cuttings and recovering drilling fluid. In this embodiment, cuttings are initially processed in vibrating separators 501A-D. However, those of ordinary skill in the art will appreciate that the cuttings may pass through several cleaning operations before entering slurrification system 500.

In this embodiment, slurrification system 580 may be coupled with a cuttings transport system 560. Once the cuttings pass through primary cleaning operation 501, the cuttings enter cuttings transport system 560. Cutting transport system 560 may include a variety of equipment, such as gravity collection systems, augers or belt conveyers, vacuum transport systems, and pneumatic transfer devices. FIG. 5 provides a schematic for a pneumatic transfer device 502. An example of a commercially available pneumatic transfer device that may be used in aspects of the present disclosure includes the CLEANCUT™ CUTTINGS BLOWER ("CCB"), from M-I LLC, in Houston, Tex. In other embodiments, cuttings transport system 560 may include, for example ISO-vessels, or other cuttings storage vessels, as described above. In this embodiment, a storage vessel 503 is coupled with pneumatic transfer device 502.

In FIG. 5, gravity feeds the cuttings into pneumatic transfer device 502 via a feed chute 565 assisted by vibration, if required. Once pneumatic transfer device 502 has been loaded with cuttings, on inlet valve (not independently shown) is closed by a two-step sealing mechanism. First, a spherical valve section (not independently shown) is rotated to block the flow of material. Second, an inflatable ring seal (not independently shown) is activated to create a seal around the inlet. Once sealed, pneumatic transfer device 502 is pressurized, and compressed air imparts motion on the cuttings. The cuttings are discharged in batches to a transfer line 504 connected to cuttings storage vessel 503, wherein the cuttings are introduced to slurrification system 580.

Cuttings storage vessel 503 may include raw material storage tanks, waste storage tanks, or any other vessels commonly used in association with drilling processes. Specifically, cuttings storage vessel 503 may include cuttings boxes, ISO-tanks, and pneumatic transfer vessels. An example of a pneumatic transfer vessel is the ISO-PUMP™, discussed above. In some embodiments, cuttings storage vessel 503 may include several individual vessels connected to allow the transference of cuttings therebetween. Cuttings storage vessel 503 may be located within a support framework, such as an ISO container frame. As such, those of ordinary skill in the art will appreciate that storage vessel 503 may be used for both drill cuttings storage and transport.

As shown in FIG. 5, and discussed in greater detail above, the cuttings are transferred to a buffer tank 510 in slurrification system 580. The cuttings then enter a transfer line 515 fluidly connected to a cuttings dryer 520. The cuttings exit cuttings dryer 520 and enter a hopper 530, wherein the cuttings enter a transfer line 535. The cuttings are mixed with a fluid in pump 540, to create a slurry. The slurry exits pump 540 and passes into a storage vessel 550 via a slurry transfer line 545. Storage vessel 550 may either hold the slurry for a future use or facilitate the transfer of the slurry to a cuttings re-injection system (not independently shown) through a CRI transfer line 555.

Figure 6:
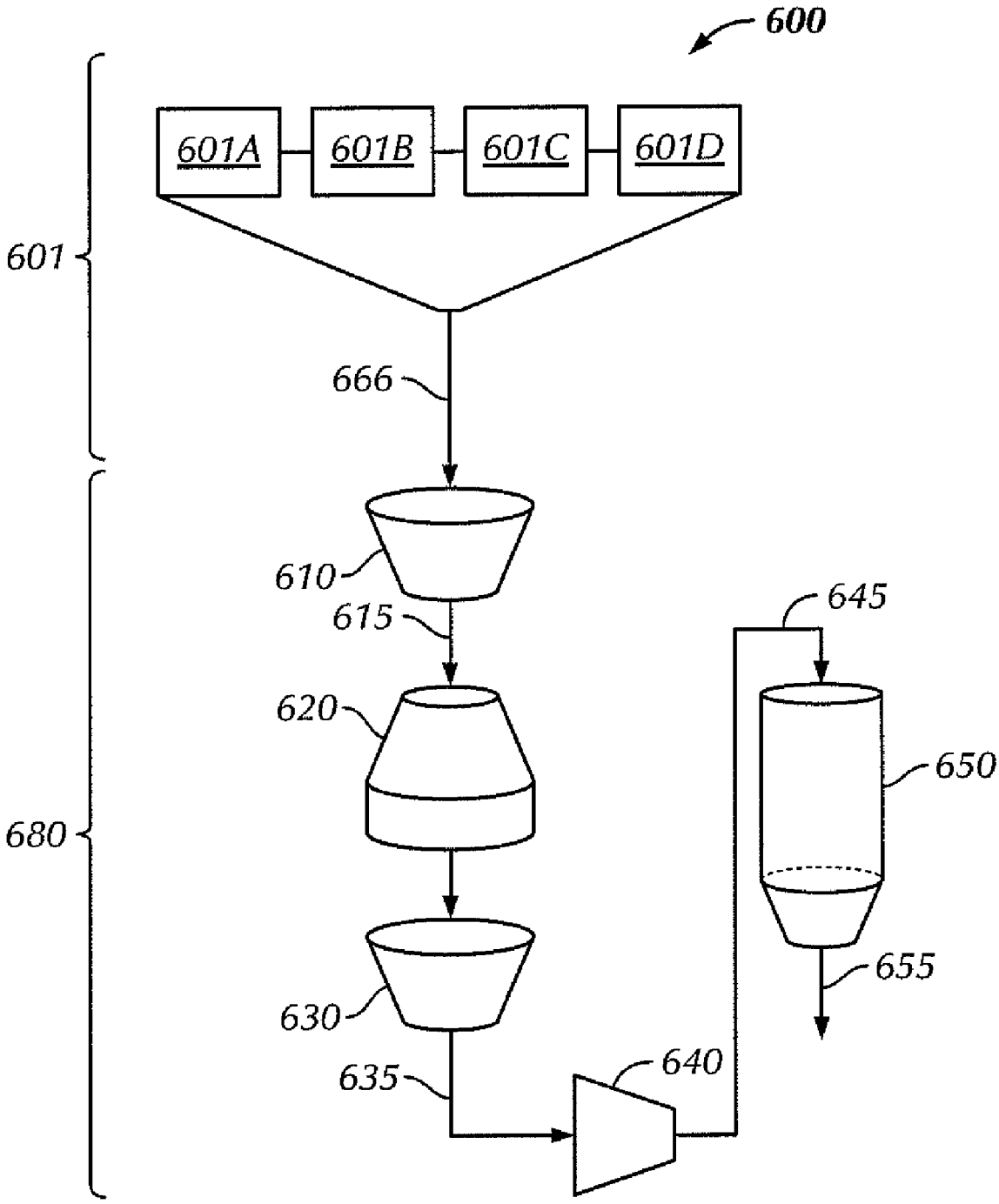
FIG. 6 shows a system for the slurrification of drill cuttings according to one embodiment of the present disclosure.

Referring to FIG. 6, a cuttings processing system 600 in accordance with one embodiment of the present disclosure is shown. In this embodiment, a slurrification system 680, as described in FIG. 1, FIG. 3, and FIG. 4, may be coupled with a primary cleaning operation 601. A drill solids conveyor (not independently shown) may be connected to shakers 601A, 601B, 601C, 601D, or other upstream cleaning equipment used to separate well fluids from solids. In this embodiment, once the cuttings pass through primary cleaning operation 601, the cuttings enter a slurrification system 680 via a transfer line 666.

As shown in FIG. 6, and discussed in greater detail above, the cuttings are transferred directly from primary cleaning operation 601 to a buffer tank 610 in slurrification system 680 via transfer line 666. The cuttings then enter a transfer line 615 fluidly connected to a cuttings dryer 620. The cuttings exit cuttings dryer 620 and enter a hopper 630, wherein the cuttings enter a transfer line 635. The cuttings are mixed with a fluid in a pump 640, to create a slurry. The slurry exits pump 640 and passes into a storage vessel 650 via a slurry transfer line 645. Storage vessel 650 may either hold the slurry for a future use or facilitate the transfer of the slurry to a cuttings re-injection system (not independently shown) through a CRI transfer line 655.

Figure 7:
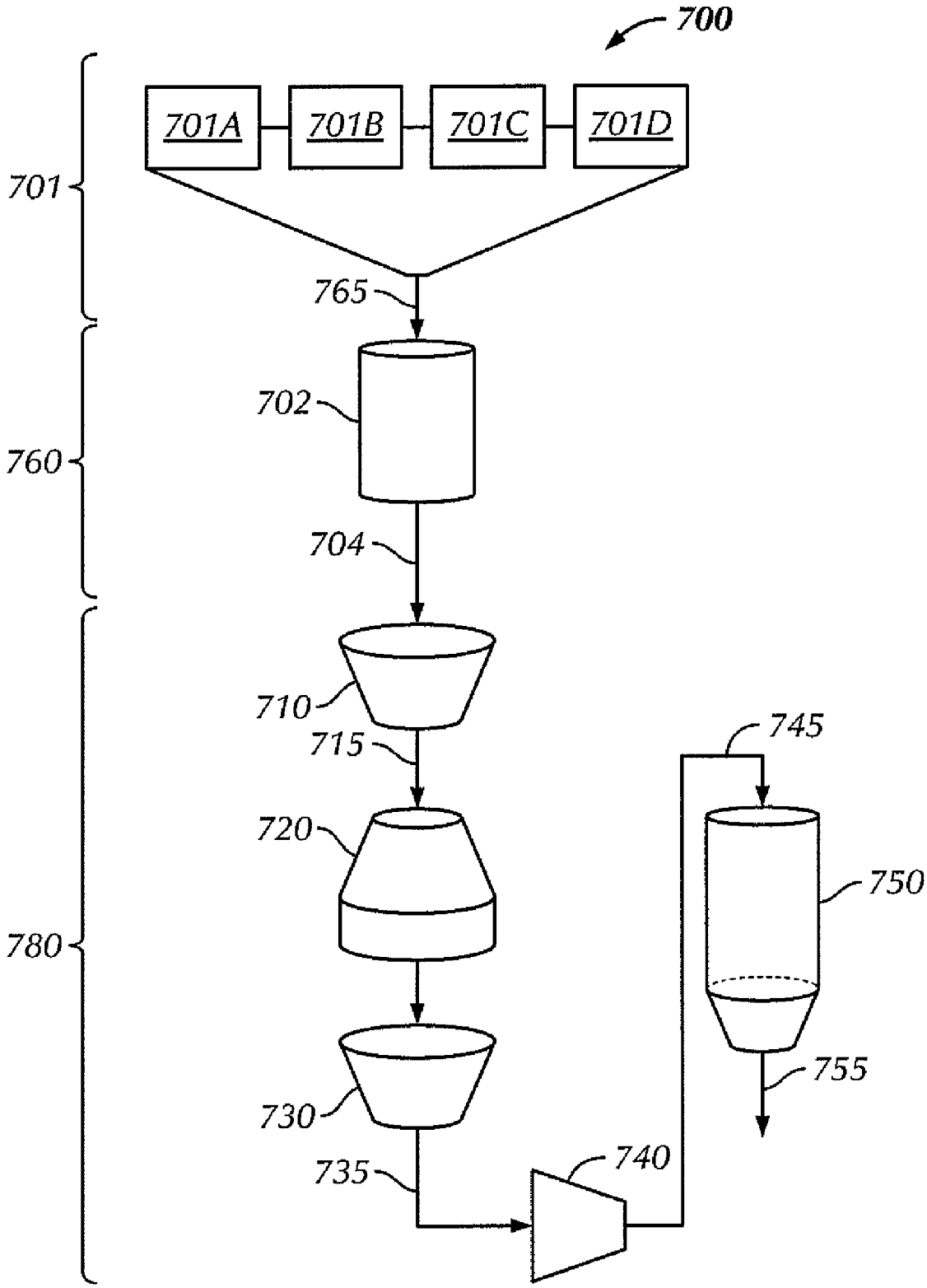
FIG. 7 shows a system for the slurrification of drill cuttings according to one embodiment of the present disclosure.

Referring to FIG. 7, a cuttings processing system 700 in accordance with one embodiment of the present disclosure is shown. In this embodiment, a slurrification system 780, as described in FIG. 1, FIG. 3, and FIG. 4, may be coupled with a primary cleaning operation 701. A drill solids conveyor (not independently shown) may be connected to shakers 701A, 701B, 701C, 701D, or other upstream cleaning equipment used to separate well fluids from solids. Once the cuttings pass through primary cleaning operation 701, the cuttings may enter a cuttings transport system 760. In this embodiment, cutting transport system 760 includes a pneumatic transfer device 702. The operation of pneumatic transfer device 702 is similar to the operation of pneumatic transfer device 502, discussed above. The cuttings enter pneumatic transfer device 702 via a feed chute 765, and the cuttings exit the pneumatic transfer device via a transfer line 704.

In this embodiment, once the cuttings pass through pneumatic transfer device 702, the cuttings enter a slurrification system 780 by transfer methods discussed above. The cuttings exit pneumatic transfer device 702 and enter a transfer line 715 fluidly connected to a cuttings dryer 720. The cuttings exit cuttings dryer 720 and enter a hopper 730, wherein the cuttings enter a transfer line 735. The cuttings are mixed with a fluid in pump 740, to create a slurry. The slurry exits pump 740 and passes into a storage vessel 750 via a slurry transfer line 745. Storage vessel 750 may either hold the slurry for a future use or facilitate the transfer of the slurry to a cuttings re-injection system (not independently shown) through a CRI transfer line 755.

Figure 8:
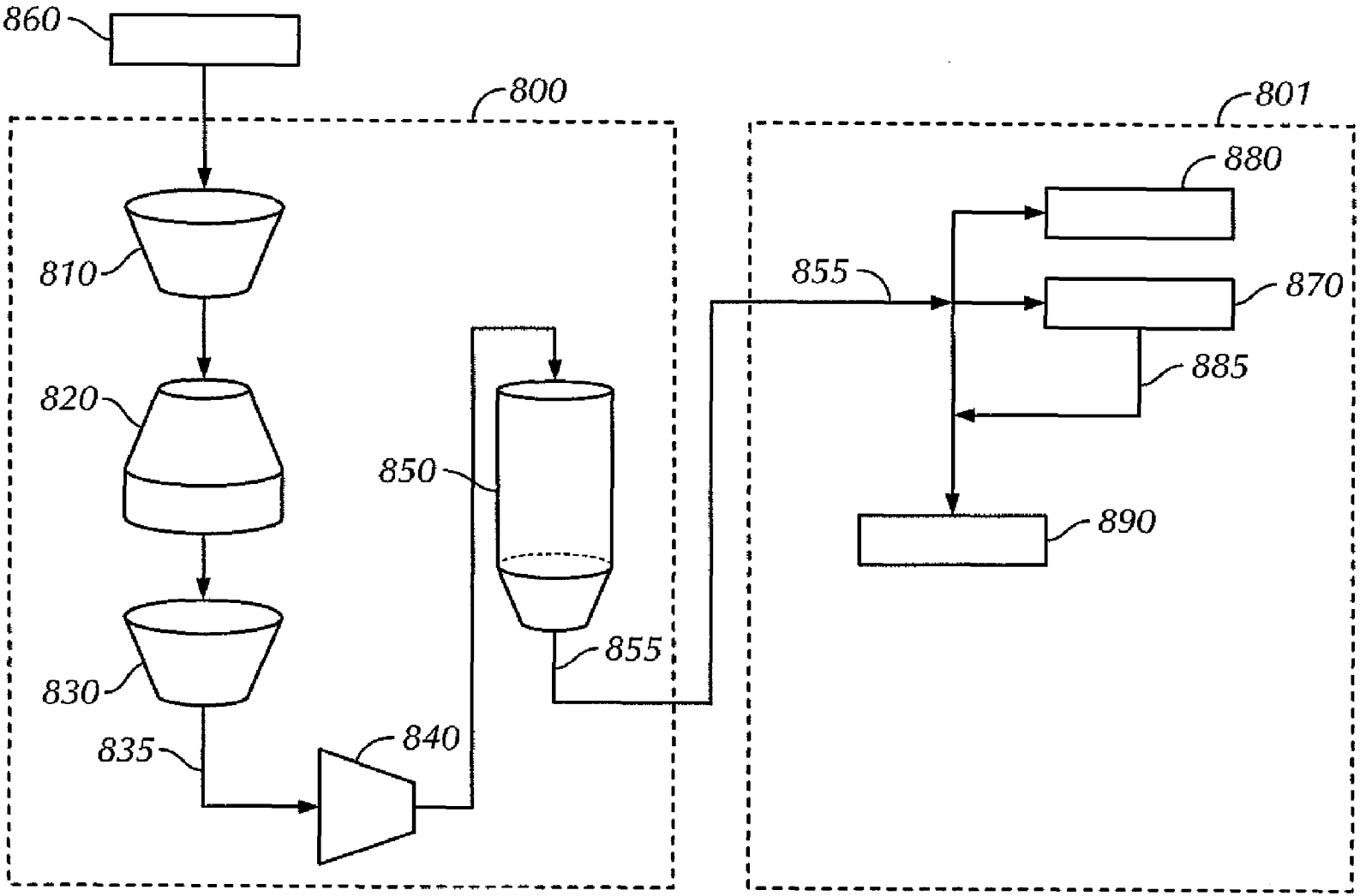
FIG. 8 shows a system for the slurrification of drill cuttings according to one embodiment of the present disclosure.

Referring to FIG. 8, a slurrification system 800 in accordance with one embodiment of the present disclosure is shown. In this embodiment, slurrification system 800, as described in FIG. 1, FIG. 3, and FIG. 4, may be coupled with a primary cleaning operation 860, as described in FIG. 5, FIG. 6, and FIG. 7, and a cuttings re-injection system 801. As described above, cuttings are processed by primary cleaning operation 860, wherein the cuttings enter slurrification process 800. In slurrification process 800, the cuttings are processed by a buffer tank 810, a cuttings dryer 820, a hopper 830, and a transfer line 835. The cuttings are mixed with a fluid in a pump 840, wherein the resulting slurry is transferred to a storage vessel 850. In this embodiment, the slurry exits the slurrification system and is introduced into cuttings re-injection system 801 via a CRI transfer line 855. In this embodiment, the slurry may be transferred to a classifier 870. In one aspect, classifier 870 determines the size range of the slurry based on diameter (i.e., particle size) and discharges the slurry to cuttings re-injection system 801 via a transfer line 885.

In another embodiment, classifier 870 may transfer the slurry to a high-pressure injection pump 890 disposed proximate wellbore via transfer line 885. As the slurry is produced by slurrification system 800, injection pump 890 may be actuated to pump the slurry into a wellbore (not independently shown). Those of ordinary skill in the art will appreciate that the re-injection process may be substantially continuous due to the operating conditions of the slurrification system. In-line slurrification systems may be continuously supplied cuttings from a drilling operation, thereby producing a substantially continuous supply of slurry for a cuttings re-injection system. Thus, once a cuttings re-injection cycle is initiated, it may remain in substantially continuous operation until a drilling operator terminates the operation. As such, even if a re-injection process is stopped, the separation of solids from the suspension may be avoided.

In aspects of this embodiment, the slurry may enter high-pressure pumps (not independently shown), low-pressure pumps (not independently shown), or both types of pumps, to facilitate the transfer of the slurry into a wellbore. In one embodiment, the pumps may be in fluid communication with each other, so as to control the pressure at which the slurry is injected downhole. However, to further control the injection of the slurry, additional components, such as pressure relief valves (not independently shown) may be added in-line prior to the dispersal of the slurry in the wellbore. Such pressure relief valves may help control the pressure of the injection process to increase the safety of the operation and/or to control the speed of the injection to further increase the efficiency of the re-injection. The slurry is then transferred to downhole tubing for injection into the wellbore. Downhole tubing may include flexible lines, existing piping, or other tubing know in the art for the re-injection of cuttings into a wellbore.

In one embodiment, the slurry may be transferred to a temporary storage vessel 880, wherein the slurry may be stored for future use in periods of overproduction. Temporary storage vessel may include vessels discussed above, such as, for example, ISO-vessels or other storage vessels that operate in accordance with the present disclosure.

Figure 9:
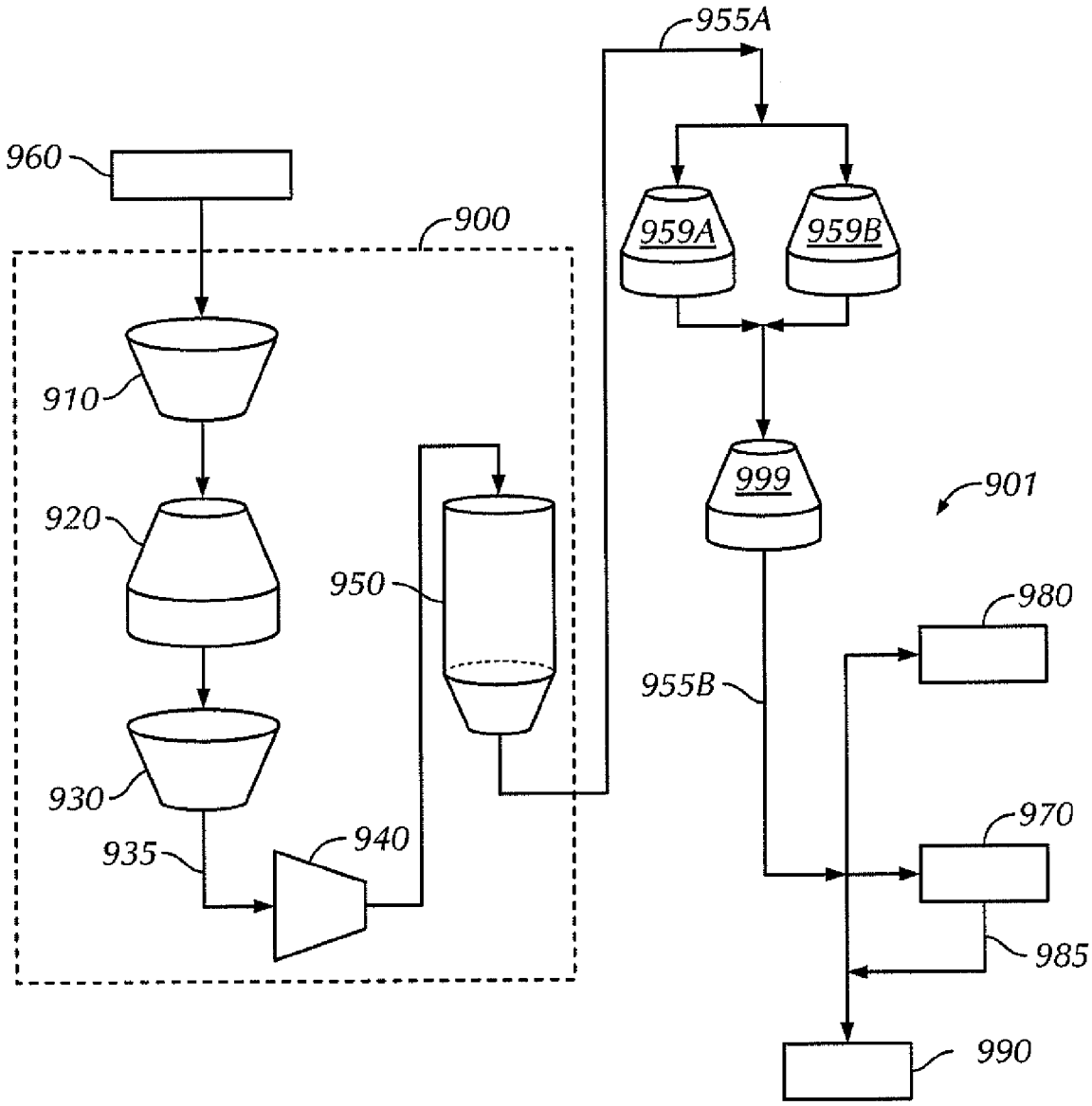
FIG. 9 shows a system for the slurrification of drill cuttings according to one embodiment of the present disclosure.

Referring to FIG. 9, a slurrification system 900 in accordance with one embodiment of the present disclosure is shown. In this embodiment, slurrification system 900, as described in FIG. 1, FIG. 3, and FIG. 4, may be coupled with a primary cleaning operation 960, as described in FIG. 5, FIG. 6, and FIG. 7, and a cuttings re-injection system 901. As described above, cuttings are processed by primary cleaning operation 960, wherein the cuttings enter slurrification process 900. In slurrification process 900, the cuttings are processed by a buffer tank 910, a cuttings dryer 920, a hopper 930, and a transfer line 935. The cuttings are mixed with a fluid in a pump 940, wherein the resulting slurry is transferred to a storage vessel 950. In the embodiment shown in FIG. 9, the slurry exits slurrification system 900 and is introduced into cuttings re-injection system 901 via a CRI transfer line 955A. In one embodiment, slurrification system 900 may be combined with other slurrification systems known in the art. For example, the slurry may pass through slurrification system 900 and move on to a series of additional slurrification device, such as a coarse tank 959A, a fines tank 959B, and a batch holding tank 999. After slurrification, the slurry may be transferred to a high pressure pump 990, temporary storage 980, and/or classifier 970 via transfer line 955B, as discussed above. Once the slurry enters classifier 970, it may be directed to high pressure pump 990 via a transfer line 985.

In one embodiment, a sensor (e.g., a density sensor, a viscometer, and/or a conductivity sensor) may be operatively coupled to a valve to open or close the valve when a predetermined condition of the slurry is met. For example, in one embodiment, a density sensor may be coupled to a valve, such that, when the density of the slurry exiting a pump reaches a pre-determined value, the valve moves (i.e., opens or closes), and redirects the flow of the slurry from a storage vessel to a second storage vessel, a slurry tank, a skip, or a injection pump for injection into a formation.

In another embodiment, a conductivity sensor may be coupled to a valve, such that, when the density of the slurry exiting a pump reaches a predetermined value, the valve moves and redirects the flow of the slurry from storage a vessel to a second storage vessel, a slurry tank, a skip, or injection pump for injection into a formation. Those of ordinary skill in the art will appreciate that other apparatus and methods may be used to redirect the flow of the slurry once a specified condition (i.e., density, conductivity, or viscosity) is met.

In yet another embodiment, the flow of cuttings, fluids, and other contents of the slurrification system may be controlled by an operatively connected programmable logic controller ("PLC"). The PLC may contain instructions for controlling the operation of a pump; such that a slurry of a specified solids content may be produced. Additionally, in certain aspects, the PLC may contain independent instructions for controlling the operation of the pump inlet or outlet. Examples of instructions may include time dependent instructions that control the time the slurry remains in a pump prior to transference through an outlet. In other aspects, the PLC may control the rate of dry material injected into a pump, or the rate of fluid transmittance through, or into, a transfer line. In still other embodiments, the PLC may control the addition of chemical and/or polymer additives as they are optionally injected into a transfer line. Those of ordinary skill in the art will appreciate that the PLC may be used to automate the addition of dry materials, fluids, and/or chemicals, and may further be used to monitor and/or control operation of the slurrification system or pump. Moreover, the PLC may be used alone or in conjunction with a supervisory control and data acquisition system to further control the operations of the slurrification system. In one embodiment, the PLC may be operatively connected to a rig management system, and may thus be controlled by a drilling operator either at another location of the work site, or at a location remote from the work site, such as a drilling operations headquarters.

The PLC may also include instructions for controlling the mixing of the fluid and the cuttings according to a specified mixing profile. Examples of mixing profiles may include step-based mixing and/or ramped mixing. Step-based mixing may include controlling the mixing of cuttings with the fluid such that a predetermined quantity of cuttings are injected to a known volume of fluid, mixed, then transferred out of the system. Ramped mixing may include providing a stream of cuttings to a fluid until a determined concentration of cuttings in reached. Subsequently, the fluid containing the specified concentration of cuttings may be transferred out of the system.

In another embodiment, a density sensor may be integral with a mixing pump, in-line before or after a storage vessel, and/or coupled to a valve anywhere in the slurrification process prior to the cuttings re-injection system, as discussed above. A valve coupled to the density sensor will allow for recirculation of the slurry through the slurrification system until the density of the slurry reaches a value determined by requirements of a given operation. In one embodiment, a valve, coupled with a density sensor and integral to a mixing pump, moves (i.e., opens or closes) and redirects the flow of the cuttings back to a buffer tank for further processing through a slurrification system. This embodiment provides a method for producing a slurry with an environmentally acceptable density.

In another embodiment, a conductivity sensor may be coupled to a valve, integral with a mixing pump, in-line before or after a storage vessel, and/or coupled to a valve anywhere in the slurrification process prior to the cuttings re-injection system, as discussed above. A valve coupled to the conductivity sensor will allow for recirculation of the slurry through the slurrification system until the conductivity of the slurry reaches a value determined by requirements of a given operation. In one embodiment, a valve, coupled with a density sensor and integral to a mixing pump, moves (i.e., opens or closes) and redirects the flow of the cuttings back to a buffer tank for further processing through a slurrification system. Those of ordinary skill in the art will appreciate that other apparatus and methods may be used to redirect the flow of the slurry once a predetermined concentration of cuttings in suspension, density, or conductivity has been met.

In one embodiment, the slurrification system may be substantially self-contained on a skid. A skid may be as simple as a metal fixture on which components of the slurriflcation system are securably attached, or in other embodiments, may include a housing, substantially enclosing the slurrification system. When the slurrification system is disposed on a skid, a drilling operation that requires a system that may benefit from increased solids content in a re-injection slurry, the slurrification system may be easily transported to the work site (e.g., a land-based rig, an off-shore rig, or a re-injection site). Those of ordinary skill in the art will appreciate that while the slurrification system may be disposed on a rig, in certain embodiments, the slurrification system may include disparate components individually provided to a work site. Thus, non-modular systems, for example those systems not including a skid, are still within the scope of the present disclosure.

Cuttings transfer systems, slurrification systems, and cuttings re-injection systems, as described above, are typically independent systems, where the systems may be located on rig permanently or may be transferred to rig from a supply boat when such operations are required. However, in embodiments disclosed herein, a system module may be located on a rig proximate cuttings storage vessels, and transfer lines may be connected therebetween to enable use of the cuttings storage vessels with tanks) pumps, grinding pumps, chemical addition devices, cleaning equipment, water supply tanks, cuttings dryers, and other components that may be used in other operations performed at a drilling location. Furthermore, embodiments of the present disclosure may be integrated to slurrification systems wherein the slurry is created in transit between collection points (i.e., at a rig or platform) and at an injection point (i.e., at a second rig, platform, or land-based drilling operations/injection site). Examples of such systems are disclosed in U.S. Provisional Application No. 60/887,449, assigned to the assignee of the present application, and hereby incorporated by reference in its entirety.

Advantageously, embodiments disclosed herein may provide for systems and methods that allow for improved environmental practices. The embodiments, as described above, may provide an advantage in meeting increasingly stringent environmental rules for offshore cuttings disposal. Moreover, the embodiments, as described above, may reduce disposal costs and encourage compliance with local regulations. In another aspect embodiments disclosed herein may provide a highly effective separation process, therefore reducing waste disposal volumes in zero-discharge applications and lower organic loading levels on the sea floor. In still another aspect, embodiments disclosed herein may assist in meeting environmental regulations relating to dry cuttings and the removal of hydrocarbons and other damaging chemicals associated with wellbore fluids, slurries, and cutting re-injections systems known to those of ordinary skill in the art.

While the present disclosure has been described with respect to a limited number of embodiments, those skilled in the art, having benefit of this disclosure, will appreciate that other embodiments can be devised which do not depart from the scope of the disclosure as described herein. Accordingly, the scope of the invention should be limited only by the attached claims.

What is claimed is:

1. A method for slurrifying drill cuttings comprising:

drying drill cuttings in a cuttings dryer to produce dry cuttings;

combining a liquid with the dry cuttings in a transfer line fluidly connecting the cuttings dryer and a mixing pump to produce a slurry;

mixing the slurry and the dry cuttings in the mixing pump; and transferring the slurry to a storage vessel.

2. The method of claim 1, wherein the method further comprises:

determining a particle size of the cuttings in the slurry.

3. The method if claim 1, wherein the combining comprises:

injecting the fluid with the dry cuttings in a hopper.

4. The method of claim 1, wherein the method further comprises:

classifying the slurry with a classifier.

5. The method of claim 4, wherein the classifier comprises:

determining at least one of a group consisting of a density of the slurry and a viscosity of the slurry.

6. The method of claim 1, wherein the method further comprises:

buffering the drill cuttings.

7. The method of claim 1, wherein the method further comprises:

transferring the slurry from the storage vessel to a cuttings re-injection system.

* * * * *